United States Patent [19]

Cornish et al.

[11] Patent Number: 4,944,603

[45] Date of Patent: Jul. 31, 1990

[54] RECLOSABLE PACKAGE WITH ENCOMPASSING TAMPER-EVIDENT BAND

[75] Inventors: Darrell G. Cornish, McFarland; Timothy G. Mally, Oregon; Daniel A. Thiemann, Windsor; Bjorn J. Thompson, Madison, all of Wis.

[73] Assignee: Oscar Mayer Foods Corporation, Madison, Wis.

[21] Appl. No.: 338,268

[22] Filed: Apr. 14, 1989

[51] Int. Cl.[5] ..... B65D 33/34

[52] U.S. Cl. ..... 383/5; 24/17 B; 383/37; 383/78; 383/61; 426/108; 426/122; 426/129

[58] Field of Search ..... 206/807; 383/5, 37, 383/90, 78, 61; 229/87 F; 24/16 R, 17 B; 426/108, 122, 129

[56] References Cited

U.S. PATENT DOCUMENTS

| | | | |
|---|---|---|---|
| 1,128,192 | 2/1915 | Smith | 383/90 |
| 1,996,682 | 4/1935 | O'Brien | 206/807 |
| 2,194,451 | 3/1940 | Soubier | 383/37 |
| 2,437,184 | 3/1948 | Brady et al. | 383/32 |
| 3,243,099 | 3/1966 | Winegard | 383/78 |
| 3,463,532 | 8/1969 | chidley et al. | 24/17 B |
| 3,581,979 | 6/1971 | Fuchs | 229/87 R |
| 3,854,581 | 12/1974 | Jones | 206/807 |
| 3,997,056 | 12/1976 | Mueller | 206/807 |
| 4,411,644 | 10/1983 | Tinklenberg | 206/807 |
| 4,423,819 | 1/1984 | Cummings | 206/807 |
| 4,823,961 | 4/1989 | Griesbach et al. | 206/632 |

FOREIGN PATENT DOCUMENTS

| | | | |
|---|---|---|---|
| 844416 | 6/1970 | Canada | 383/5 |
| 2051003 | 1/1981 | United Kingdom | 383/5 |

OTHER PUBLICATIONS

"Tamper Evident Labeling " advertisement, May 19, 1983.

*Primary Examiner*—Stephen P. Garbe

*Attorney, Agent, or Firm*—Joseph T. Harcarik

[57] ABSTRACT

A flexible, bag-like package which includes an access opening containing a reclosable seal at or near its top edge, is encompassed by a tamper-evident band. The band is bonded to the front and back wall panels of the package and extends across the access opening. Attempts to remove the band in order to open the package will result in disruption of the band or the wall panels.

9 Claims, 1 Drawing Sheet

RECLOSABLE PACKAGE WITH ENCOMPASSING TAMPER-EVIDENT BAND

FIELD OF THE INVENTION

This invention relates to flexible, bag-like packages which are closed or sealed along any bottom or side edge portions and which are provided with a reclosable opening means along the remaining top edge portion. These packages, which may be conveniently opened and reclosed, provide considerable convenience to the consumer.

DESCRIPTION OF THE PRIOR ART

Flexible, bag-like packages which have an inner, hermetic seal and an outer reclosure seal are presently known for packaging various food products, such as wieners, bacon, sliced luncheon meats, chops, cheese and the like. One such package, including the materials of construction, is fully described in U.S. Pat. No. 4,782,951 to Hustad and Griesbach which is hereby incorporated by reference. A common application of such packaging is to seal the food product between two sheets of film material to form a generally rectangular shaped package which is hermetically sealed (e.g., heat sealed) about three sides and which has an access means at the fourth side. According to the aforementioned patent, the access means includes both an outer reclosable zipper seal and an inner, hermetic peel seal.

A problem which exists with packages, including vacuum-packed and gas-flushed packages, wherein the access opening consists of only a reclosable seal is that the package may be opened and then reclosed without showing outwardly visible evidence of such openings. Thus, a package which has been opened and reclosed, but from which no contents have been removed, would have an outward appearance somewhat comparable to a package which has not previously been opened. Of course, if the package were to contain a secondary, non-reclosable seal, such as an inner peel seal, a consumer who purchases and thereafter opens a previously-opened package should be able to determine that the secondary peel seal has been broken. It would, however, be preferred that it be readily apparent to the consumer in the store (i.e., before purchase) that the package had been previously opened.

Various techniques have been known for providing visual, tamper-evident features on flexible packages. U.S. Pat. No. 3,780,781 to Uramoto, U.S. Pat. No. 4,015,771 to Sengeivald and U.S. Pat. No. 4,786,190 to Van Erden et al., are examples of such tamper-evident packages. It is desirable, however, to develop other tamper-evident features which are both economical and convenient and which are suitable for use with hermetically (e.g., vacuum-packed or gas-flushed) packaged foodstuffs.

DESCRIPTION OF THE INVENTION

The packages of the present invention have a unique combination of features. The packages are in-store tamper-evident, such that it is apparent to the consumer that the package has been opened upon even casual examination of the package. The package has a band which encompasses at least a portion of the package, which passes across the access opening and which serves as a tamper-evident feature. The package also has a reclosure seal which may be opened and reclosed a number of times in order to remove portions of the package contents. The reclosure seal is preferably a liquid-tight seal which is not susceptible to interference by contact with the fluids (e.g., water, juices, oils, etc.). which may be a component of the packaged product. A zipper seal consisting of interlocking closure strips is the preferred reclosure seal means. A pressure-sensitive, adhesive seal would also be useful as the reclosure seal, especially for packaging dry products.

Additionally, the package may have a reclosable or non-reclosable hermetic seal, such as an easy-open or peel seal. This hermetic seal is generally parallel to the reclosure seal and is openable with digital pull-apart forces which may be the same forces used to open the reclosable seal. This hermetic seal can preserve a vacuum, a pressurized and/or a modified gaseous environment within the flexible package. A non-reclosable peel seal may be formed by effecting a face-to-face seal between two plys of plastic film with the strength of the seal permitting separation without destruction or tearing of either ply. One method of producing such a peel seal is described in the Hustad and Greisbach patent where the contacting surfaces of the two plys are of dissimilar materials and are sealed together by means of heat and pressure. Peel seals could also be produced by means of pressure-sensitive adhesives.

The tamper-evident band may be a paper, cardboard or plastic material which is permanently bonded to the front and back of the bag and extends across the access opening which is located at the top of the bag. The band will typically completely encircle the bag; however, this is not necessary. The band will preferably be bonded to the bag by means of an adhesive; however, in the case of bands formed of a heat-sealable material, it would be possible to heat seal the band to the bag. In either event, it is necessary to provide a sufficiently strong bond so that attempts to remove the band will result in visible disruption of either the band itself or of the bag surfaces to which it is bonded.

Bands which are suitable for use in this invention are well-known in the art and have been employed on packages for link-shaped meat products, such as wieners. According to prior practice, these bands have extended around the front, back and sides of the package in a direction which is parallel to any access opening provided on the package. According to the present invention, the band extends across the front, back and top of the package and is perpendicular to the reclosure seal which is contained in the access opening.

These bands have previously been used primarily for the purpose of labeling the package, which is typically a package made from one or more laminated, plastic films. In the case of link-shaped products, the bands have encompassed the package in a direction which is perpendicular to the orientation of the links. In the practice of the present invention, the band will typically extend in the same direction as the orientation of the links.

According to the present invention, the band will still provide a surface for imprinting graphics; however, the band will now also serve as a tamper-evident feature. The orientation or printing on the band will be in a direction, typically from bottom to top of the package, which will be most advantageous for reading the graphics when the packages are placed in a refrigerated storage bin or shelf and are presented for sale to the consumer.

In the practice of this invention, the reclosable package with its desired contents will preferably be formed, filled and sealed, preferably hermetically-sealed, in a single operation. As described in the Hustad and Griesbach patent, these packages may be made on a single machine using a straight-through process. Subsequent to the formation and sealing of the package, the band is applied across the access opening and bonded to the package. Typically, the band fully encircles the package and is bonded at its end by means of an overlapped adhesive bond. It would also be possible to use a shrink band which is placed in position and then shrunk to securely encompass the package.

As used in this invention and the description thereof, the top of the package is meant to refer to that segment of the package perimeter that contains the access opening. The bottom of the package would therefore be that portion of the package which is opposite the top.

Although the invention is described in terms of a single band encompassing a single package, it should be apparent that more than one band could be used if the access opening were of considerable length. Also, as in presently commercially practical for wieners, the band could encompass a plurability (e.g., two) of flexible, bag-like, reclosable packages which are stacked one on top of another. In the event the band will be secured to the front or top surface of this uppermost package and the back or lower surface of the lowermost bag. Such embodiments of dual (or more) packages are to be considered within the spirit, scope and claims of the present invention.

The features and objects of the present invention will be readily apparent from the following detailed description thereof taken in conjunction with the accompanying drawings.

DESCRIPTION OF THE PREFERRED EMBODIMENT

In the description of the preferred embodiments set out below, it will be recognized by those skilled in the art that various alternative materials and structures which are not specifically disclosed are also within the scope of this invention. For instance, although a rectangular package is shown, other shapes such as triangular or round could be utilized. Likewise, although vacuum-packed wieners are shown, gas-flushed packing and other package contents could be employed.

For purposes of illustration and discussion, each bag panel or ply will be shown as a single heat-sealable lamina. In actual practice, each bag panel will likely be a laminate of two or more layers which will provide sufficient protection to the product (e.g., oxygen and moisture barriers) and which can form a peelable, hermetic seal at their inner surfaces. As is known to the art, a surface of "Saran", a vinylidene chloride-vinyl chloride copolymer, in contact with a surface of ethylene vinyl acetate can form such bonds. The peel seal should have an opening force of from 1.5 to 6.0 pounds as discussed in the Hustad and Griesbach patent.

The reclosure seal can be comprised of interlocking closure strips which are adhesively bonded or heat sealed to the inner face of each bag panel. Alternatively, the reclosure elements can be integrally formed on the film during the film extrusion process.

Figure 1:
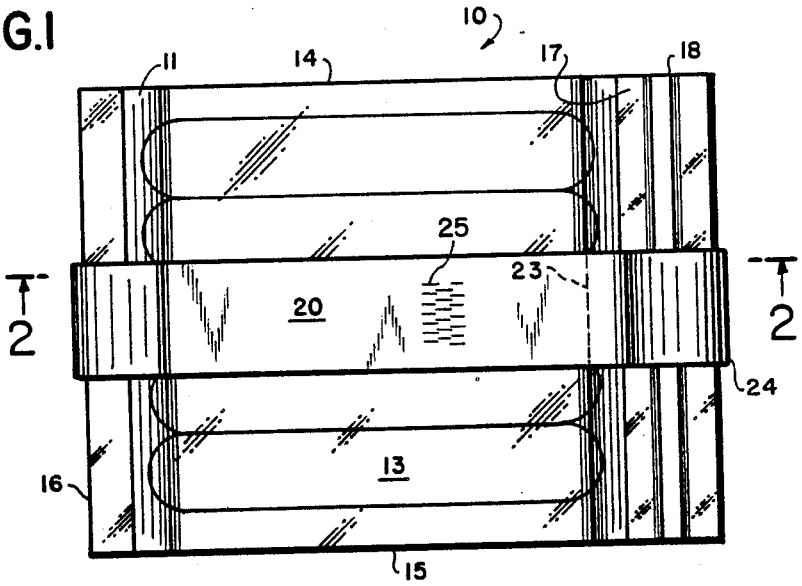
FIG. 1 is a plan view illustrating one embodiment of a tamper-evident, reclosable, hermetically-sealed package in accordance with this invention. For purposes of illustration only, the package is shown as containing vacuum-packed wieners.
Figure 2:
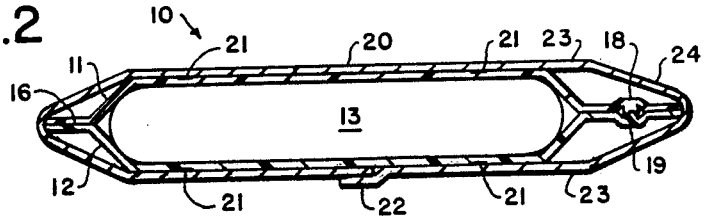
FIG. 2 is a cross-sectional, elevational view taken along the line 2—2 of FIG. 1.

FIGS. 1 and 2 illustrate a package 10 formed of top and bottom bag panels 11 and 12 which enclose a plurality of wiener-shaped products 13. The wieners 13 are vacuumed packed so that the bag panels are in intimate contact with the surface of the wieners. Bag panels 11 and 12 are sealed along side edges 14 and 15 by means of continuous heat seals. The bottom edge 16 of the bag may be sealed by an additional heat seal, or alternatively, the bottom edge may be a fold which forms a continuous sheet into opposed panels 11 and 12. A non-reclosable, hermetic peel seal 17 extends across the width of the package, the seal being formed as a result of low-intensity heat-sealing equipment.

Interlocking reclosure strips 18 and 19, which form the reclosable seal, are bonded to the inner surfaces of bag panels 11 and 12 at a location which is parallel to and spaced-apart from hermetic peel seal 17.

Tamper-evident band 20 is shown as encompassing the package 10 and bonded to bag panels 11 and 12 by means of adhesive spot bonds 21. The band is joined at its ends by means of a overlap seal 22. It may be desirable to include spaced-apart lines of perforations 23 on band 20 so that the portion 24 of the band which extends across the access opening of the bag may be neatly removed. Band 20 may be printed with label graphics 25.

Figure 3:
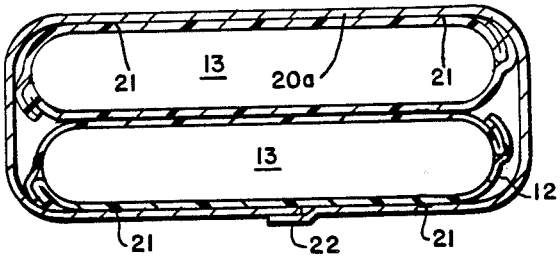
FIG. 3 is a cross-sectional, elevational view of another embodiment of this invention.

As shown in FIG. 3, it may be desirable to fold the top and/or bottom portions of the bag (i.e., the portion which extends beyond product) back against the product-containing portion of the bag. In this manner, band 20 will contact the bag around essentially the entire circumference of the band. FIG. 3 also illustrates a plurality of packages, one stacked on top of the other, and the tamper-evident band **20*a*** encompasses both of the packages.

While various embodiments of packages illustrating this invention have been described, it will be apparent that certain modifications and variations therefrom may be made without departing from the spirit and scope of this invention. Accordingly, only such limitations are to be imposed thereon as are indicated in the appended claims.

Having thus described the invention what is claimed is:

1. In a flexible package wherein a product is sealed between opposed front and back wall panels, wherein the package is permanently sealed about any bottom and side edges and contains an access opening at a top edge and wherein the access opening contains a reclosure seal, the improvement comprising a tamper-evident band which is permanently bonded to the front and back wall panels and extends across and spans a portion of the access opening spaced from said access opening, such that attempts to remove the band will result in visible disruption of either the band itself or the front or back wall panel, said reclosure seal is a zipper seal, said band contains at least two lines of perforations which are spaced apart from each other and which define and facilitate removal of said portion of the band which extends across the access opening at the top edge of the flexible package to thereby provide substantially unobstructed digital access to said zipper seal for opening and closing same.

2. The package of claim 1 wherein the band completely encircles the package.

3. The package of claim 1 wherein the band is a paper, cardboard or elastic band.

4. The package of claim 1 wherein the band completely encircles the package and the ends of the band are bonded with an overlap seam.

5. The package of claim 1 wherein the band is adhesively bonded to the front and back wall panels.

6. The package of claim 1 wherein the access opening includes a hermetic peel seal which is parallel to the zipper seal.

7. The package of claim 1 wherein the package has a rectangular shape, wherein the product is a plurality of link-shaped meat products which are oriented to be parallel to the side edges of the package, wherein the band completely encircles the package and is adhesively bonded to the wall panels, and wherein the band is printed with label graphics which are oriented in the direction of the link-shaped meat products.

8. The package of claim 7 wherein the access opening includes a hermetic peel seal which is parallel to and positioned below the zipper seal.

9. The package of claim 7 wherein the band encompasses a plurality of bag-like packages which are stacked one on top of another.

* * * * *